US005787828A

United States Patent [19]

Barbier et al.

[11] Patent Number: 5,787,828

[45] Date of Patent: Aug. 4, 1998

[54] SWATH CARGO SHIP

[75] Inventors: Brian K. Barbier, Berwick; John B. Crabtree, Jr., Houma; Peter W. Tsang, Thibodaux, all of La.

[73] Assignee: Service Marine Industries, Inc., Amelia, La.

[21] Appl. No.: 755,565

[22] Filed: Nov. 27, 1996

[51] Int. Cl.[6] ..... B63B 1/24

[52] U.S. Cl. ..... 114/61; 114/274

[58] Field of Search ..... 114/61, 59, 265, 114/274, 275, 280; D12/309, 300, 304

[56] References Cited

U.S. PATENT DOCUMENTS

| | | | |
|---|---|---|---|
| 3,141,437 | 7/1964 | Bush et al. | 114/280 |
| 3,279,407 | 10/1966 | Stenger | 114/280 |
| 3,447,502 | 6/1969 | Leopold | 114/61 |
| 3,530,815 | 9/1970 | Lewlson | 114/61 |
| 3,730,123 | 5/1973 | Lang | 114/280 |
| 4,174,671 | 11/1979 | Seidl | 114/61 |
| 4,440,103 | 4/1984 | Lang | 114/61 |
| 4,763,596 | 8/1988 | Yoshida | 114/265 |
| 4,909,174 | 3/1990 | Bowes | 114/265 |
| 4,919,063 | 4/1990 | Hall et al. | 114/56 |
| 5,282,763 | 2/1994 | Dixon | 440/42 |
| 5,295,453 | 3/1994 | Inoue | 114/61 |
| 5,355,827 | 10/1994 | Barbazash et al. | 114/274 |
| 5,408,948 | 4/1995 | Arii et al. | 114/274 |
| 5,645,008 | 7/1997 | Loui | 114/274 |

FOREIGN PATENT DOCUMENTS

| | | | |
|---|---|---|---|
| 0002987 | 1/1977 | Japan | 114/265 |
| 0080987 | 5/1982 | Japan | 114/280 |
| WO 81/00241 | 2/1981 | WIPO | 114/61 |
| WO 93/25431 | 12/1993 | WIPO | 114/61 |

*Primary Examiner*—Ed L. Swinehart
*Attorney, Agent, or Firm*—Kennedy,Davis & Kennedy

[57] ABSTRACT

A small water plane area twin hull (SWATH) ship (10) has two demi-hulls (11), a strut (12) mounted to each hull which extends to a cross structure (14) spanning the struts. A buoyant foil (18) extends between the two hulls.

4 Claims, 4 Drawing Sheets

SWATH CARGO SHIP

TECHNICAL FIELD

This invention relates generally to maritime vessels used for transporting cargo, and particularly to the hulls of such vessels.

BACKGROUND OF THE INVENTION

Today, ships which carry a substantial quantity of cargo are typically constructed with a monohull having large displacement characteristics. This type of hull however is susceptible to the forces of waves encountered at sea, as well as those encountered while docked. These wave forces often cause the vessels to pitch, roll and heave to a large degree. The motion of the vessel often causes passenger and crew discomfort and increases the risk of dislodging and shifting of cargo. Such motion can damage the vessels as they move relative to off-shore rigs, docks and other ships to which they are moored. This lack of stability also hinders the loading and off-loading of cargo.

Small water plane area twin hull vessels, which are referred to by the acronym SWATH, and which also have been called semi-submerged vessels, have heretofore been developed for high stability and safety at sea. This type of vessel has two submerged, parallel, torpedo-shaped hulls and vertical struts which extend upwardly a substantial distance above the water line to a connecting cross structure that spans the struts. The superstructure and deckhouse of the vessel is supported upon this cross structure. Because the submerged hulls provide the entire buoyancy of the vessel, such have not been capable of transporting large tonnages of cargo. If, however, a ship could be developed with the cargo capacity of a typical monohull vessel but also with the safety and stability of a SWATH vessel, such would be ideally suited for use in the transporting of cargo. Accordingly, it is to the provision of such that the present invention is directed.

SUMMARY OF THE INVENTION

In a preferred form of the invention a swath cargo ship comprises two generally parallel hulls and two generally parallel buoyant struts that extend upwardly from the hulls. A cross structure is supported above and spanning the two buoyant struts. A buoyant foil is mounted to and spans the two hulls. The two hulls, the two struts and the buoyant foil collectively provide the buoyancy to establish a ship water line located below the cross structure and above the hulls and foil with the ship afloat.

DETAILED DESCRIPTION

Figure 1:
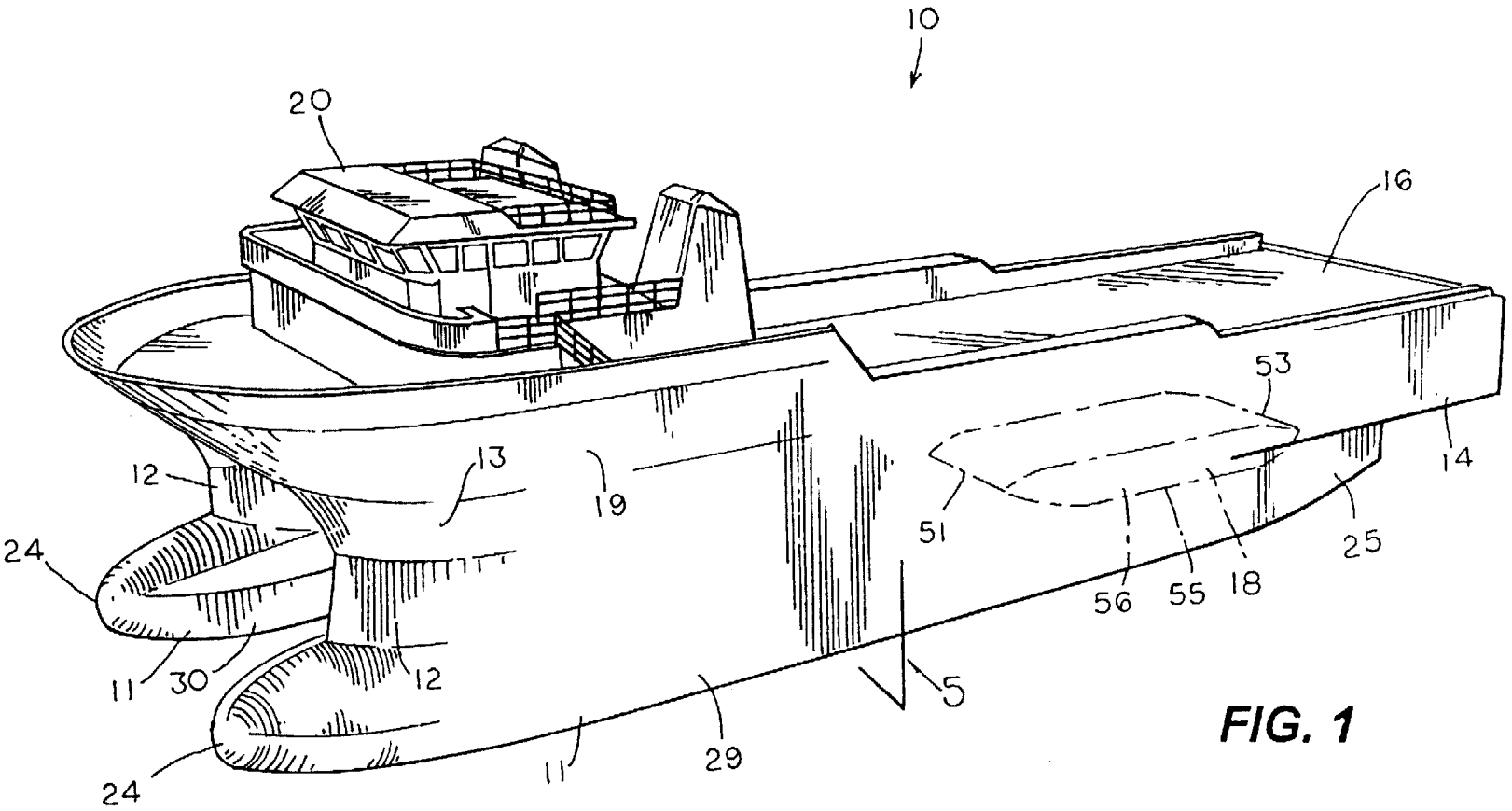
FIG. 1 is a perspective view of a swath ship embodying principles of the invention in a preferred form.
Figures 2, 3:
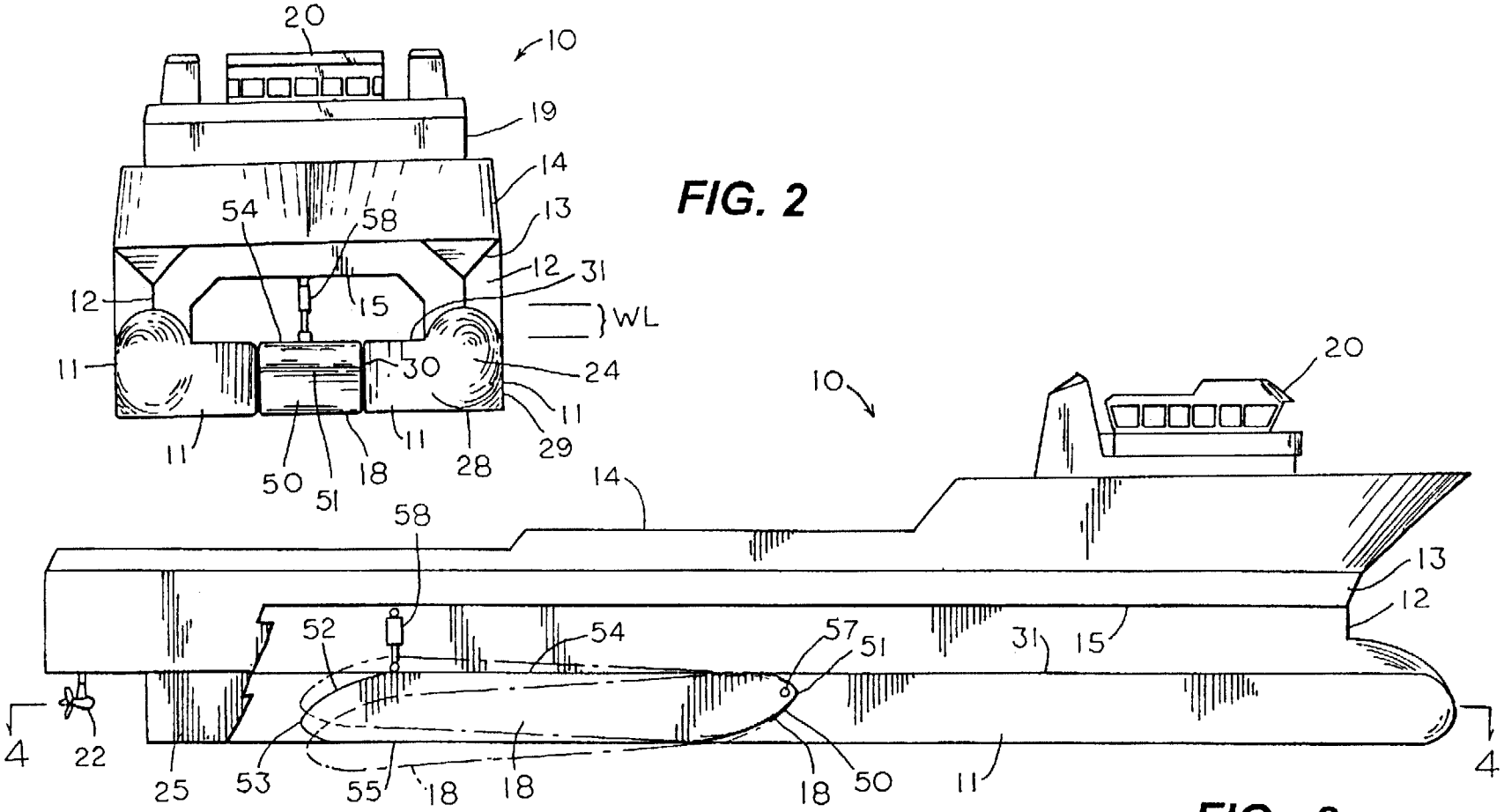
FIG. 2 is a front view of the swath ship of FIG. 1.
FIG. 3 is a side view in partial cross-section of the swath ship of FIG. 1.

With reference next to the drawings, there is shown a small water plane area twin hull, or SWATH ship 10 having two parallel lower, demi-hulls 11 and an elongated strut 12 associated with each hull 11 which extends upward from each hull to a haunch portion 13 of a cross structure 14. The cross structure 14 has a wet deck 15 and a weather deck 16. Cargo is stowed upon the weather deck during transportation. The hulls 11 extend inwardly toward each other inboard of their associated struts 12, as best shown in FIG. 2. A hollow, preferably air-filled buoyant foil 18 is mounted between the two hulls 11. The ship 10 also has a superstructure 19 extending upwardly from the cross structure 14 and a deckhouse 20. Two rotatable Z-drives 22 are mounted to the cross structure 14 at the stern of the ship below the water line for ship propulsion.

Figure 5:
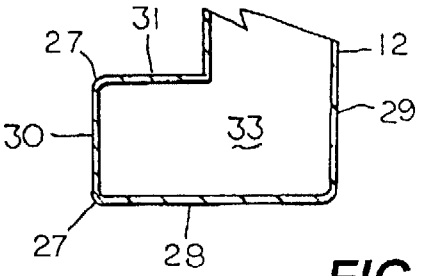
FIG. 5 is a side view in partial cross-section of a swath ship in an alternative embodiment.

The ship has two bulbous bows 24 jointly formed by the forward end of the hulls. The bulbous bows 24 are located along the range of water lines WL associated with the ship, as best shown in FIG. 3. These water lines change, of course, according to the loaded state of the ship. The vast majority of the hulls 11 aft of the bulbous bow 24 and forward of the tapered stern 25 is rectangular in shape, as best shown in FIG. 5, with respect to a cross-sectional plane 5 extending laterally through the hulls in FIG. 2. The hulls are formed by a bottom wall 28, an outboard side wall 29, an inboard side wall 30, and a top wall 31.

Figure 4:
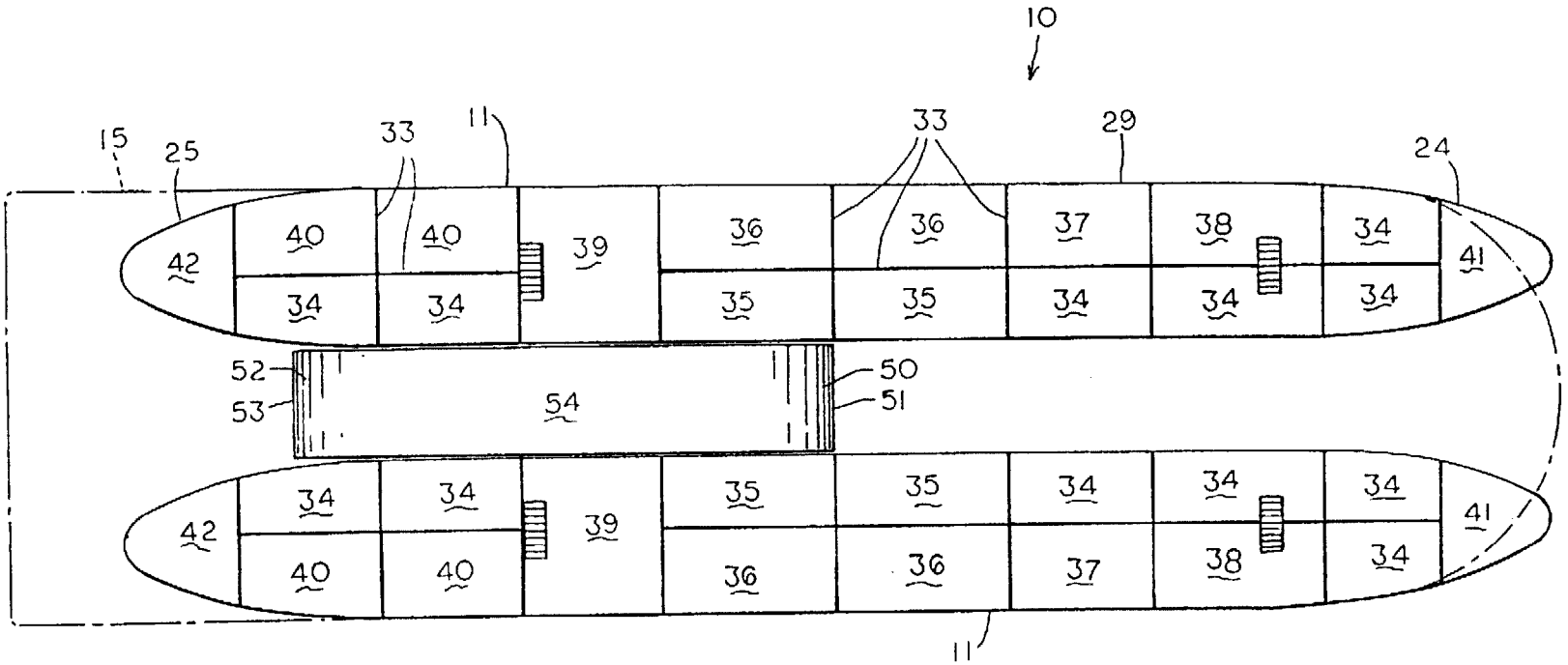
FIG. 4 is a cross-sectional view of the swath ship of FIG. 1 taken along plane 4—4.

The hulls 11, struts 12 and cross structure 14 are internally divided by internal divider walls or bulkheads 33 to form distinct independent bays and tanks, some of which extend from nearly the bottom of the ship nearly to the weather deck 16. As shown in FIG. 4, the bulkheads define six ballast tanks 34 for liquid cargo, two fuel oil tanks 35 for storing fuel oil used by the ship, two cargo tanks 36 for holding liquid or liquid-like cargo and ballast such as oil, mud and cement, a potable water tank 37, a forward machine room 38, a rearward machine room 39 and two storage spaces containing pressure tanks for the storage of dry cements and lubricants. The bulkheads also form a forward void 41 and a rear void 42. A conventional piping system provides controlled fluid communication between the liquid tanks 36, fuel oil tanks 35, and water tanks 37 and the weather deck of the cross structure for the loading and off loading of liquid, liquid-like cargo and dry cement and the like.

The buoyant foil 18 has a tapered front 50 terminating at a generally horizontal nose 51, a tapered rear 52 terminating at a generally horizontal trailing edge 53, a top wall 54, a bottom wall 55 and two side walls 56. Here, the foil 18 is mounted to the hulls for pivotal movement about pivot 57 in adjusting its angle of attack to the sea. Alternatively, it may be fixed as hereinafter described. Pivotal movement of the foil is performed through operation of a hydraulic cylinder 58 mounted between the foil adjacent its tapered rear 52 and the cross structure 14. The foil is adapted to be pivoted some 10°, as shown in phantom lines in FIG. 3.

With the foil in its neutral position, midway in its pivot range, its top wall 54 is generally aligned with the top walls 31 of the hulls and its bottom wall 55 is generally aligned with the bottom walls 28 of the hulls. Pivotal movement of the foil allows it to be adjusted to maximize ship operation at various speeds and under various sea conditions. Its hollow construction provides a large buoyancy force in addition to that provided by the hollow hulls and struts. The buoyancy collectively provided by the hulls, struts and foil establish a ship water line that ranges depending upon its loaded condition from slightly above the top of the hulls to a level spaced below the wet deck of the cross structure as shown at WL in FIG. 2. This buoyancy allows the swath type ship to carry a very large cargo load without increasing draft compared with that of prior art swath ships. This additional buoyancy also increases the pitch and heave motion resistance of the ship. Note that the foil extends from amidship to adjacent the stern of the ship.

The struts 12 here extend substantially and continuously from the ship bow to stern. This, in combination with the struts being very wide, provides the ship with much greater buoyancy than prior art swaths. This additional buoyancy allows the ship to carry a greater load such that it can truly be referred to as a swath cargo ship. Also, the addition of the foil reduces the stresses the hulls place upon the haunch portion 13 of the ship and also aids in reducing the prying and shearing forces of the hulls. The overall result is an offshore ship with the stability and safety of a swath and yet with much enhanced cargo carrying capability.

When underway, the flat bottom walls 28 of the hulls provide a lifting force which raises the ship and decreases its draft. This raising of the ship increases efficiency by reducing the surface area of the strut in contact with the water and thereby reduces the strut-induced drag. The bulbous bows 24 swell the water ahead of the struts which decreases the water resistance upon the struts, further increasing the operating efficiency of the ship. The bulbous bows further enhance ship efficiency by directing the flow of water below the hulls further increasing the lifting force of the flat bottom walls 28. Through the bulbous bows of the hulls are usually at the ship water line, as shown in FIG. 2, the vast majority of the hulls to the rear of the bow is below the water line. Thus, the bulbous bows are intended herein to be referred to separately from the term hull wherein reference is made to the water line.

The side walls of the cross structure 14, the outboard side walls of the haunch portions 13, the outboard side walls of the struts and the outboard side walls 29 of the hulls are generally flat and co-planar. This alignment of virtually the entire outboard side of the ship prevents it from hanging onto or catching and damaging structures to which the ship is docked during rough seas. This reduces damage to both the ship and the structure to which it is moored.

With the ship having an overall length of approximately 220 feet, the foil preferably measure approximately 76 feet in length and approximately 11 feet in height as does each hull. This size foil provides approximately 300 tons of buoyancy, approximately 10% of the overall buoyancy of the ship. If no foil is provided, then the hulls provide approximately 80% of the buoyancy and the struts provide approximately 20%.

The just described ship is extremely stable. Under most sea conditions its roll and pitch are limited to 2° in any loaded condition. This is a great improvement over monohulls which typically roll or pitch up to 15°. The ship is capable of sailing seas of greater than 10 foot swells, as opposed to monohull vessels of the prior art which were unable to sail safely in such sea conditions. Also, this ship configuration provides a large weather deck area on which cargo may be stowed.

Figure 6:
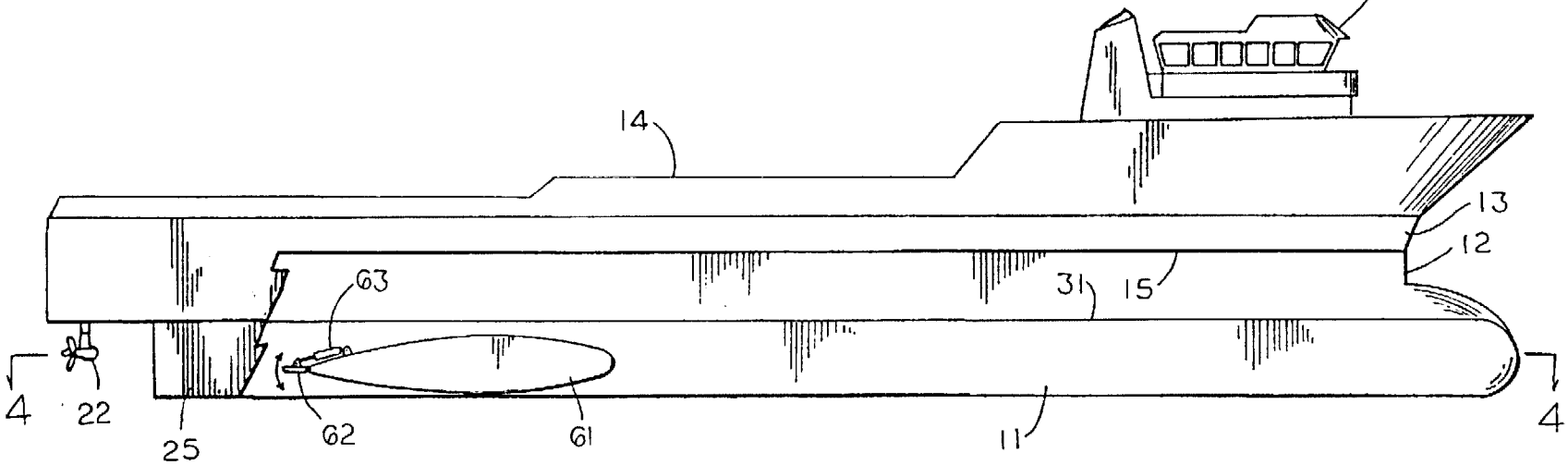
FIG. 6 is a side view in partial cross-section of the swath ship according to another preferred embodiment of the invention.

The foil may be fixedly mounted to the hulls. It also may be filled with a material more buoyant than water. This increases the structural strength of the foil and prevent the foil from filling with water should a breach occur. Thus in FIG. 6 there is shown a swath cargo ship 60 embodying principles of the invention in another preferred form. Here, the ship is essentially of the same construction as that previously described except for the wing-shaped foil 61 which is fixed to the hulls. Though the foil 61 is substantially the same height as the movable foil 18, it does have a pivotable trailing trim plate or hydrotail fin 62. Otherwise it is equivilant to a bouyant cross-hull member. The trim plate 62 is pivotably movable by a hydraulic cylinder 63. The foil 61 is approximately 53 feet in length and approximately 8 feet in height. This size provides approximately 200 tons of buoyancy or approximately 6.6% of the overall buoyancy of the ship. With the ship having an overall length of 220 feet, a beam length of 60 feet, the fully loaded draft of the ship is approximately 16 feet. The ship has approximately 7,350 square feet of deck cargo area and is capably of carrying 800 tons of deck cargo. It is also capable of carrying 228,600 gallons of ballast, 88,800 gallons of potable water, 77,200 gallons of fuel oil, 2,000 gallons of lube oil, 4,000 barrels of liquid mud of other liquid cargo, 8,000 cubic feet of bulk mud or other powdered cargo, and berth 26 persons.

The size and configuration of the foil is, of course, determined by the size of the ship and the desired quantity of cargo the ship is to carry. Preferably, the foil provides between 1% and 10% of the buoyancy of the ship.

It thus is seen that a swath type cargo ship is now provided which has the stability and safety of swath type vessels and yet has the cargo carrying capacity of a monohull vessel. It should however be understood that the just described embodiment merely illustrates principles of the invention in its preferred form. Many modifications, additions and deletions may, of course, be made thereto without departure from the spirit and scope of the invention as set forth in the following claims.

We claim:

1. A swath cargo ship comprising two generally parallel hulls each of which has a bulbous bow; two generally parallel buoyant struts that extend upwardly from said hulls; a cross structure supported above and spanning said two buoyant struts; and a buoyant foil mounted to and spanning said two hulls, said hulls, struts and foil having a seawater displacement providing a ship water line that extends across said bulbous bows in all cargo load conditions.

2. A swath cargo ship comprising a cross structure having two opposite sides; two generally parallel struts, each said strut depending from one said side of said cross structure, two generally parallel longitudinal hulls, a buoyant foil mounted between said hulls, each of said hulls being mounted to a lower end of one of said struts and having a bulbous bow, and wherein said hulls, struts and foil are sized to displace a volume of seawater to provide a ship water line that extends across said bulbous bows in all cargo load conditions.

3. The swath cargo ship of claim 2 wherein said buoyant foil has a pivotal trim plate.

4. The swath cargo ship of claim 2 wherein said buoyant foil is mounted to said two hulls for movement in adjusting the foil angle of attack.

* * * * *